US006280167B1

(12) United States Patent
Pahl et al.

(10) Patent No.: US 6,280,167 B1
(45) Date of Patent: Aug. 28, 2001

(54) GEAR RING PUMP HAVING A HOUSING WALL WITH A HOLLOW CONE RECESS

(75) Inventors: Arnold Pahl, Markgroeningen; Rolf Hummel, Steinenbronn; Gerd Baur, Rettenberg-Freidorf, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,918

(22) PCT Filed: Oct. 27, 1998

(86) PCT No.: PCT/DE98/03135

§ 371 Date: Aug. 25, 2000

§ 102(e) Date: Aug. 25, 2000

(87) PCT Pub. No.: WO99/37922

PCT Pub. Date: Jul. 29, 1999

(30) Foreign Application Priority Data

Jan. 22, 1998 (DE) ..... 198 02 137

(51) Int. Cl.[7] ..... F04C 2/10
(52) U.S. Cl. ..... 418/75; 418/171
(58) Field of Search ..... 418/75, 78, 79, 418/166, 171

(56) References Cited

U.S. PATENT DOCUMENTS 2,872,872 * 2/1959 Quintilian ..... 418/171
4,968,233 * 11/1990 Nakayoshi et al. ..... 418/171

FOREIGN PATENT DOCUMENTS

2249395 * 6/1973 (DE) .

* cited by examiner

*Primary Examiner*—John J. Vrablik
(74) *Attorney, Agent, or Firm*—Ronald E. Greigg; Edwin E. Greigg

(57) ABSTRACT

A gear pump has a gear wheel with teeth on an outer circumference and a second gear ring with teeth on the inside surface. The gear ring is guided in a circular-cylindrical recess of a housing and together with the gear wheel, each rotates about their own axis which are offset from one another. The gear pump is equipped with an intake opening and a crescent-shaped pressure opening in a first side wall of the housing that defines the recess. A countersunk feature is also provided, embodied as a hollow cone, in a second wall of the housing opposite the pressure opening. The hollow cone, which is in fluid communication with the pressure opening, promotes the buildup of a fluid film between the gear ring and the housing, which improves the wear resistance of the gear pump.

7 Claims, 2 Drawing Sheets

GEAR RING PUMP HAVING A HOUSING WALL WITH A HOLLOW CONE RECESS

PRIOR ART

The invention is based on a gear pump which is driven by an electric drive motor.

One such gear pump is already known (German Patent Disclosure DE 22 49 395 A1), whose second wall of the housing is provided with countersunk features of appropriate outline that are axially opposite both the crescent-shaped intake opening and the crescent-shaped pressure opening of the first side wall. The countersunk features, embodied with sharp edges, have a bottom extending parallel to the end face toward the gear wheel of the side wall and the countersunk features have walls protruding upward at a right angle. The purpose of the countersunk features is to compensate for axial forces engendered by the fluid to be pumped and exerted by the intake opening and in particular by the pressure opening on the gear ring, and to improve the running properties and the wear performance of the gear pump. However, the countersunk features can be produced only at relatively great expense and are designed unfavorably from the standpoint of lubrication technology.

ADVANTAGES OF THE INVENTION

The gear pump of the invention has an advantage over the prior art that on the one hand the countersunk feature can be created by metal-cutting machining using a simple tool, and on the other, a load-bearing film of fluid from the countersunk feature can favorably form between the gear ring and the second side wall of the housing, which considerably improves the wear resistance of the gear pump.

Expedient features and refinements of the gear pump of the invention are set forth hereinafter.

BRIEF DESCRIPTION OF THE DRAWINGS

One exemplary embodiment of the invention is shown in simplified form in the drawings and described in further detail below.

DESCRIPTION OF THE EXEMPLARY EMBODIMENT

Figure 1:
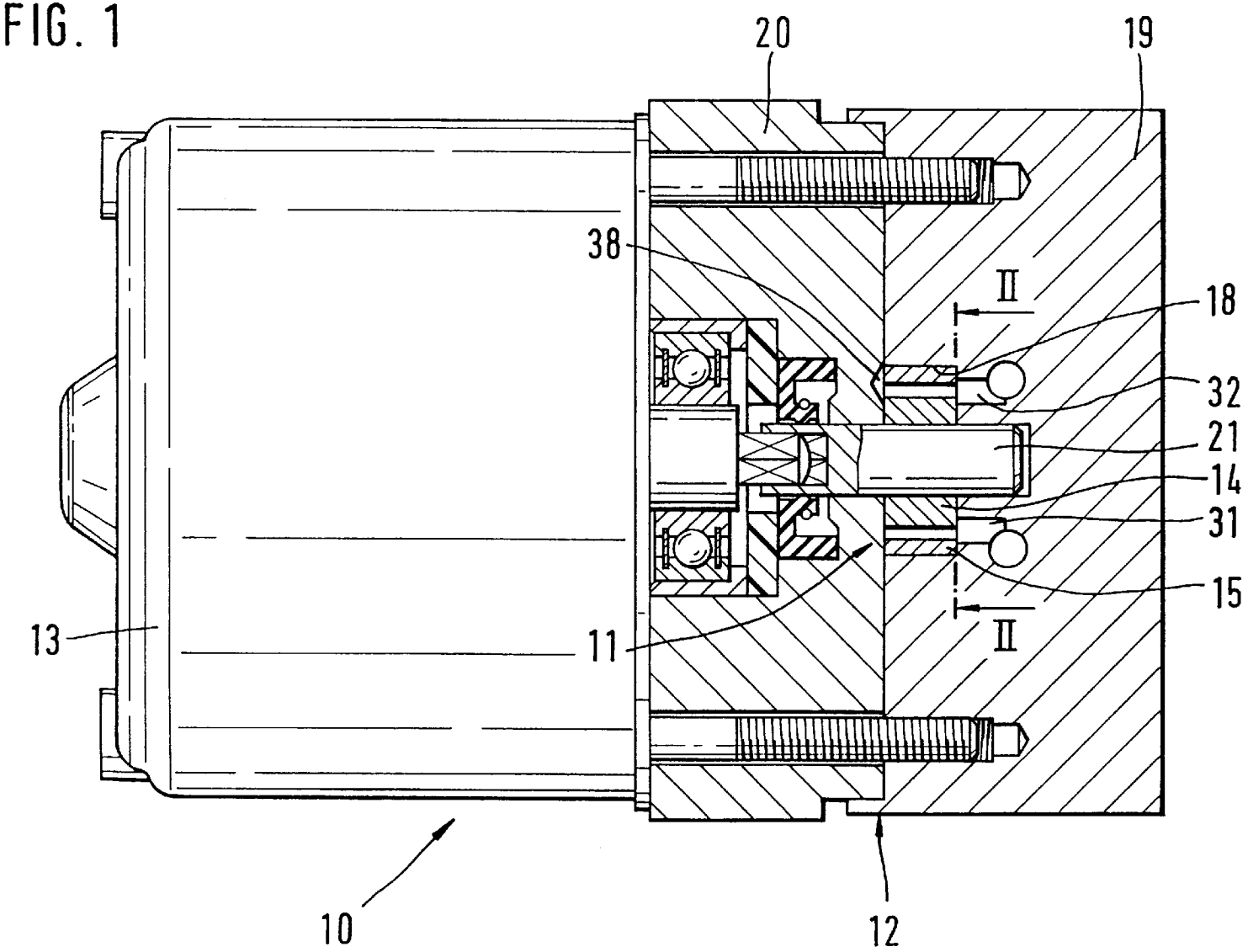
FIG. 1 shows a longitudinal section through a pump unit with a gear pump.

A pump unit 10 has a gear pump 11 in a two-part housing 12 and also has an electric drive motor 13 (FIG. 1) which is secured to the two-part housing. The gear pump 11 is formed by a gear wheel 14 with teeth on the outside circumference and by a gear ring 15 with teeth on the inside. The gear pump 11 is of the crescentless internal gear pump (Gerotor pump) type. Its gear ring has a finite number of teeth 16 and a number, less than that by one tooth, of teeth 17 of the gear wheel 14. The gear wheel 14 and the gear ring 15 are received in a circular-cylindrical recess 18 of a first part 19, remote from the motor, of the housing 12. Toward the drive motor 13, the recess 18 is closed off by a second part 20 of the housing 12. The gear wheel 14 is disposed in a manner fixed against relative rotation on a pump shaft 21, which is coupled to the drive motor 13 and is guided in the housing 12.

Figure 2:
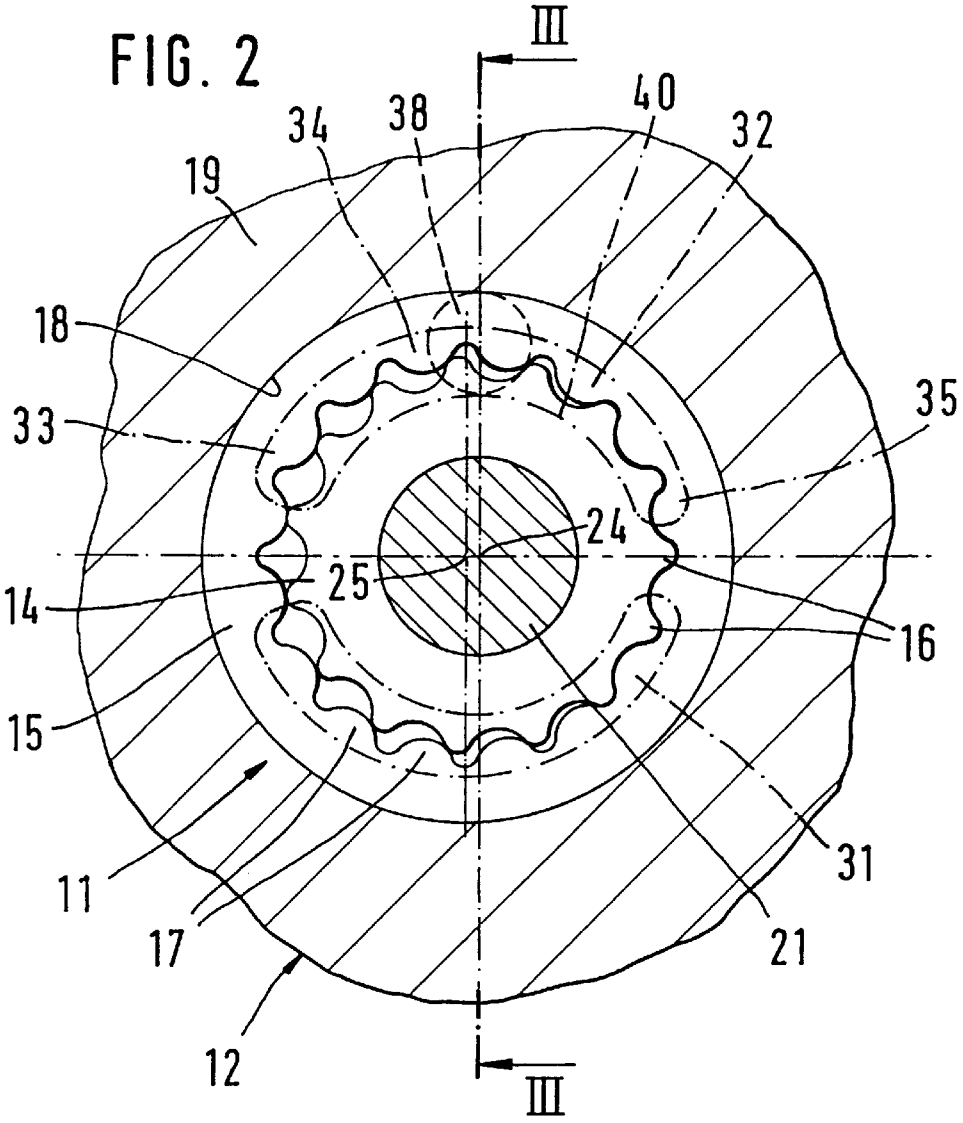
FIGS. 2 and 3 show sections through the gear pump taken along the line II—II in FIG. 1 and III—III in FIG. 2, respectively, on a larger scale than in FIG. 1.
Figure 3:
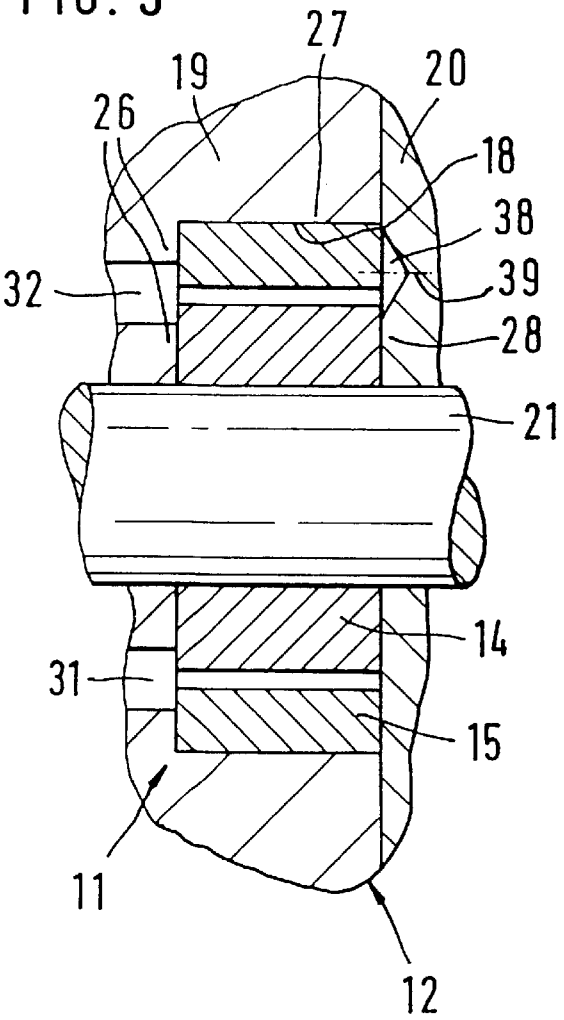

The gear wheel 14 and the gear ring 15, which mesh with one another, can be driven clockwise, in terms of FIG. 2; the gear ring is set into rotation by the driven gear wheel. The gear wheel 14 and the gear ring 15 have axes 24 and 25, respectively, that are offset from one another. The axis 24 of the gear wheel 14 is at the same time the axis of the pump shaft 21, while the axis 25 of the gear ring 15 coincides with the axis of the recess 18. The recess 18 is axially defined by a first side wall 26 of the housing part 19 (FIG. 3). At the same time, the housing part 19 forms a jacket wall 27 that radially guides the gear ring 15. Finally, on a side opposite the first side wall 26, the recess 18 is defined by a second wall 28, formed by the housing part 20. The first side wall 26 and the second side wall 28 take on the axial guidance of the gear wheel 14 and the gear ring 15.

In the first side wall 26 of the housing part 19, an intake opening 31 and a pressure opening 32 for hydraulic fluid to be pumped by the gear pump 11 are formed. The openings 31 and 32, which in the view of FIG. 2 are located in front of the plane of the drawing and are therefore suggested by dot-dashed lines, each have a crescent-shaped outline and extend approximately concentrically to the axes 24 and 25 of the gear wheel 14 and gear ring 15. The intake opening 31 and the pressure opening 32 each extend over about 150° of the circumference of the gear wheel 14 and gear ring 15. In the circumferential direction, the two openings 31 and 32 assume a mutual spacing which is equal to at least one tooth spacing. The intake opening 31 and the pressure opening 32 change their radial width over their course. The pressure opening 32, in the direction of rotation (clockwise) of the gear wheel 14 and the gear ring 15, successively has an inlet zone 33, a middle zone 34, and an outlet zone 35. The inlet zone 33 has a greater radial width than the middle zone 34, and the outlet zone 35 is narrower than the middle zone 34.

A countersunk feature in the form of a hollow cone 38 is located opposite and in fluid communication with the pressure opening 32 in the second side wall 28 of the housing part 20. The hollow cone 38 has an opening that is toward the recess 18; the axis 39 of the hollow cone 38 extends parallel to the longitudinal axis 25 of the recess 18. The hollow cone 38 has a cone angle of about 120°. The orifice cross section (diameter) of the hollow cone 38, which with a jacket wall is adjacent to the recess 18, and is selected such that the hallow cone is overtaken at least by the full radial width of the gear ring 15. In the exemplary embodiment shown, the orifice cross section of the hollow cone 38, beginning at the jacket wall 27, extends toward the axis 25 to beyond the toothed ring of the gear wheel 14 (FIG. 2). It can also be seen from FIG. 2 that the orifice cross section of the hollow cone 38 extends as far as the radially inner boundary wall 40 of the pressure opening 32.

The hollow cone 38 is disposed in the side wall 28 of the housing part 20, opposite the middle zone 34 of the pressure opening 32. In operation of the gear pump 11, the fluid pumped by the gear wheel 14 and gear ring 15 reaches both the pressure opening 32 and the inside of the hollow cone 38. Because of the rotary motion of the gear wheel 14 and in particular the gear ring 15, the fluid is carried out of the hollow cone 38 and forms a film that supports both the gear wheel and in particular the gear ring on the side wall 28. At the same time, fluid also enters the gap between the jacket of the gear ring 15 and the jacket wall 27 of the housing part 19. The fluid film forms a load-bearing layer, so that the area of mixed friction upon startup of the gear pump 11 is rapidly traversed and is avoided during pump operation. At the same time, the fluid film creates a load- bearing layer, which at least partly compensates for axial forces acting on the gear ring 15 from the pressure opening 32.

As already suggested, the diameter of the hollow cone 38, its cone angle, and its location in the recess 18 can all be selected in a manner departing from the exemplary embodiment. For instance, the cone angle can be varied within the limits of 90 and 150°, to exert influence on the drag flow that carries fluid out of the hollow cone. Furthermore, the hollow cone 38 can be shifted into the region of the inlet zone 33 of the pressure opening 32. With respect to the course of the fluid pumped by the gear pump 11, this achieves an earlier building in the feeding direction of the supporting fluid film under the gear ring 15. The foregoing relates to a preferred exemplary of embodiments of the invention, it being understood that other variants and embodiments thereof are possible within the spirit and scope of the invention, the latter being defined by the appended claims.

What is claimed is:

1. A gear pump (11) including first and second housing parts (19, 20), a gear wheel (14) with teeth on an outside circumference and a gear ring (15) with teeth on an inside surface, the gear ring is guided in a circular-cylindrical recess (18) of a housing part (19) and together with the gear wheel (14) rotates about their own axis (24, 25) which are offset from one another, an intake opening (31) and a crescent-shaped pressure opening (32) in a first side wall (26), defining the recess (18), of the first housing part (19), and a countersunk feature (38), opposite and in fluid communication with the pressure opening (32), in a second wall (28) of the second housing part (20) that defines the recess (18) on another side, and the countersunk feature is embodied as a hollow cone (38).

2. The gear pump of claim 1, in which the hollow cone (38) has a cone angle between 90 and 150°.

3. The gear pump of claim 2, in which the hollow cone (38) is disposed with an axis (39) extending parallel to an axis (25) of the recess (18).

4. The gear pump of claim 1, in which the orifice cross section of the hollow cone (38) is overtaken at least by the gear ring (15).

5. The gear pump of claim 1, in which the orifice cross section of the hollow cone (38) is overtaken by the gear ring (15) and at least by the teeth (17) on the gear wheel (14).

6. The gear pump of claim 1, in which the hollow cone (38) is disposed in the middle zone (34) of the pressure opening (32).

7. The gear pump of claim 1, in which the hollow cone (38) is disposed in the region of the inlet zone (33) of the pressure opening (32).

* * * * *